United States Patent [19]

Love

[11] 4,010,823

[45] Mar. 8, 1977

[54] METHODS AND APPARATUS FOR INSPECTING AND/OR WORKING INSIDE OF A LARGE DRUM

[75] Inventor: George H. J. Love, Huntington Beach, Calif.

[73] Assignee: Texaco Inc., New York, N.Y.

[22] Filed: Nov. 21, 1975

[21] Appl. No.: 634,097

[52] U.S. Cl. ..... 182/128; 182/142; 182/150

[51] Int. Cl.[2] ..... E04G 1/36

[58] Field of Search ..... 182/128, 142, 150; 52/741

[56] References Cited

UNITED STATES PATENTS

| | | | |
|---|---|---|---|
| 3,420,332 | 1/1969 | Textor | 182/128 |
| 3,491,851 | 1/1970 | Dutcher | 182/142 |
| 3,556,252 | 1/1971 | Atkins | 182/128 |

*Primary Examiner*—Reinaldo P. Machado
*Attorney, Agent, or Firm*—Carl G. Ries; Thomas H. Whaley; Theron H. Nichols

[57] ABSTRACT

Methods and one apparatus are disclosed for inspecting or working on the internal wall surface of a large drum, as a five story high coke drum for use in a delayed coking unit for restoring petroleum fractions. The apparatus or assembly comprises a triangular spider hanging bracket hoisted up to and connected to one end of a crosshead secured across the top of an opening in the top of the drum, and an inspector's or workman's cage having a hoist hooked to one end of the triangular bracket for traversing the full height of one sector of the drum internal wall before the cage is lowered to a temporary deck, the crosshead rotated through a predetermined angle on the drum top, and the cage raised again for covering another sector of the internal wall surface. This assembly forms a fast, thorough, safe, economical, and efficient system for inspecting and/or working on the internal wall surface of a large drum.

9 Claims, 3 Drawing Figures

METHODS AND APPARATUS FOR INSPECTING AND/OR WORKING INSIDE OF A LARGE DRUM

BACKGROUND OF THE INVENTION

The inspection and/or working on, as painting or repairing the inside of a large drum, as one about 50 feet high has been a time taking, expensive task to perform in the past. Before, either hoists were used from several stories high to lower an inspector's platform or painter's platform into an opening in the top of the five story drum or scaffolds have had to be built inside the drum for performing the work necessary to be carried out, whether it be merely inspecting the internal wall surface or repairing the walls. This temporary scaffolding can be very unsafe if much work and time are not put into them, which time, as 3 to 4 days. means more down time for the drum. With repairs requiring four to eight days, the total down time of the drum can amount to a substantial loss and accordingly should be reduced to as little as possible. The disclosed invention may be used in any drum, such as but not limited to, a coke drum in a delayed coking unit for restoring petroleum fractions in an oil refinery.

Accordingly, features of this invention reside in a saving of time and expense by permitting rapid, thorough inspection of the coke drums in sections or intervals, pinpointing and evaluating repairs, and improving start of repair time.

OBJECTS OF THE INVENTION

Accordingly, a primary object of this invention is to provide a method for inspecting and/or working on the internal wall surface of a large drum.

Another primary object of this invention is to provide a lift bracket assembly for use in inspecting and/or working on the internal wall surface of a large drum that is fast, thorough, safe, economical, and efficient.

A further object of this invention is to provide a few methods and a mechanism that is easy to operate, is of simple configuration, is economical to build and assemble, and is of greater efficiency for the inspection, painting, and/or working on the internal wall surface of a large drum.

Other objects and various advantages of the disclosed methods and at least one apparatus will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, one form or mechanism for carrying out the methods of the invention wherein like reference numerals have been employed to indicate similar parts in the several views in which.

DESCRIPTION OF THE INVENTION

Figure 2:
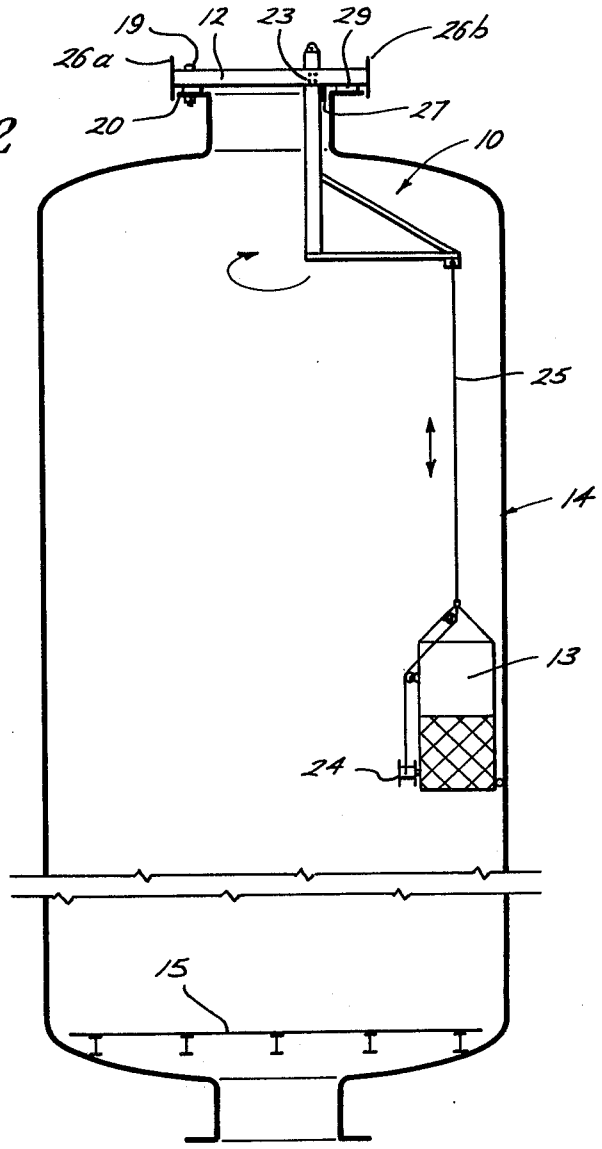
FIG. 2 is a view similar to FIG. 1 with the lift bracket assembly installed and operating.

The invention disclosed herein, the scope of which being in the appended claims, is not limited in its application to the details of construction and arrangement of parts shown and described for carrying out the disclosed methods, since the invention is capable of being formed in other embodiments for carrying out other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises a few methods for inspecting and/or working on the internal wall surface of a large drum and a single mechanism for practicing the methods.

A method for inspecting and/or working on the internal wall surface of a large drum, as about five stories high, having a flange on the top rim thereof comprises, 1. assembling a right angled spider hanging bracket having a vertical support column and a horizontal lift bracket yoke,
2. attaching a first hoist cable to the vertical support column,
3. attaching an end of a cable from a second hoist on an inspector's/worker's cage to a protruding end of the horizontal lift bracket yoke,
4. securing a crosshead support across the top of the drum rim flange,
5. lifting the right angled spider hanging bracket with the first hoist to a position immediately under the drum rim flange with the vertical support column adjacent to the crosshead support and the horizontal lift bracket yoke protruding end extending to a position adjacent the wall surface,
6. rigidly attaching the vertical support column to the crosshead support whereby the protruding end of the horizontal lift bracket yoke is adjacent to the drum wall surface, and
7. hoisting the inspector's/worker's cage up and down from the protruding end of the horizontal lift bracket yoke adjacent the drum wall surface to cover one sector at a time of the drum internal wall surface for providing a fast, thorough, safe, economical, and efficient method of inspecting and/or working on the internal wall surface of a large drum.

Another method may include the first seven steps listed above with the following five steps added as:

8. lowering the inspector's/worker's cage to the bottom of the drum,
9. detaching the crosshead support from the drum rim flange,
10. rotating the crosshead support on the upper surface of the drum rim flange through a predetermined angle of another sector,
11. reattaching the crosshead support to the drum rim flange, and 12. hoisting the inspector's/worker's cage up and down for inspecting and/or working on the next sector of the drum internal wall surface.

The above method may be modified further by adding the following step:

13. rotating the crosshead support on the drum rim flange to the predetermined angle after each successive inspection/work trip until a rotation of 360° is traversed or the tank inspection and/or work is completed.

All of the above methods may be modified by adding the following two steps:

8. securing detachable interconnecting means between the crosshead support and the drum rim flange to maintain the crosshead support on the drum rim flange when the inspector's/worker's cage is being hoisted up and down, and
9. detaching the crosshead support from the drum rim flange when the inspector's/worker's cage is rotated to another sector of the drum internal wall surface.

DESCRIPTION OF THE APPARATUS

Figure 1:
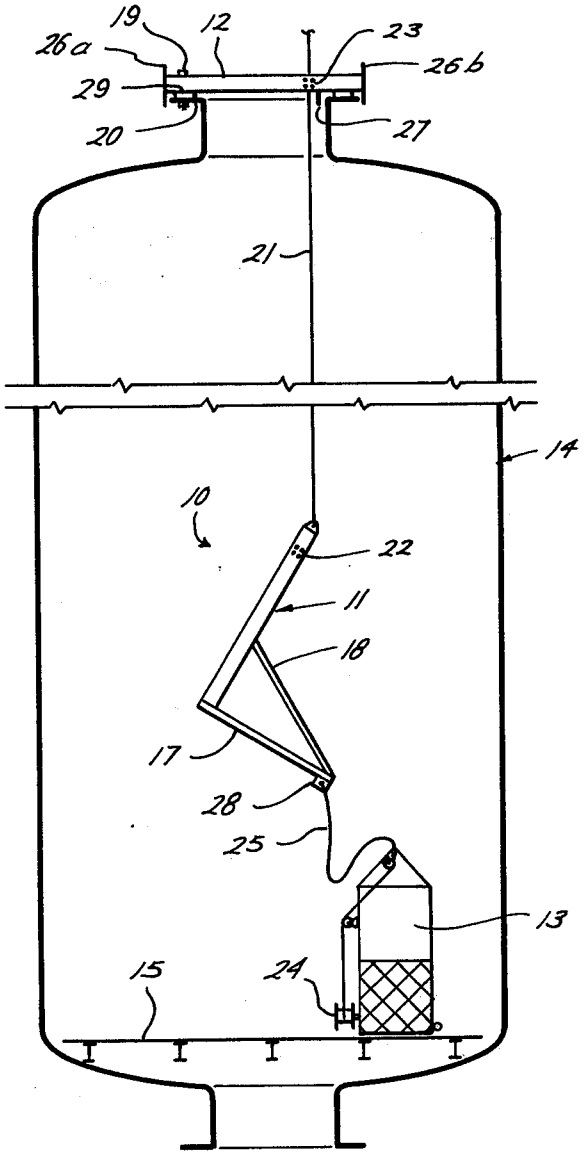
FIG. 1 is a schematic front elevation of a coke drum with the lift bracket assembly being installed with parts in section.
Figure 3:
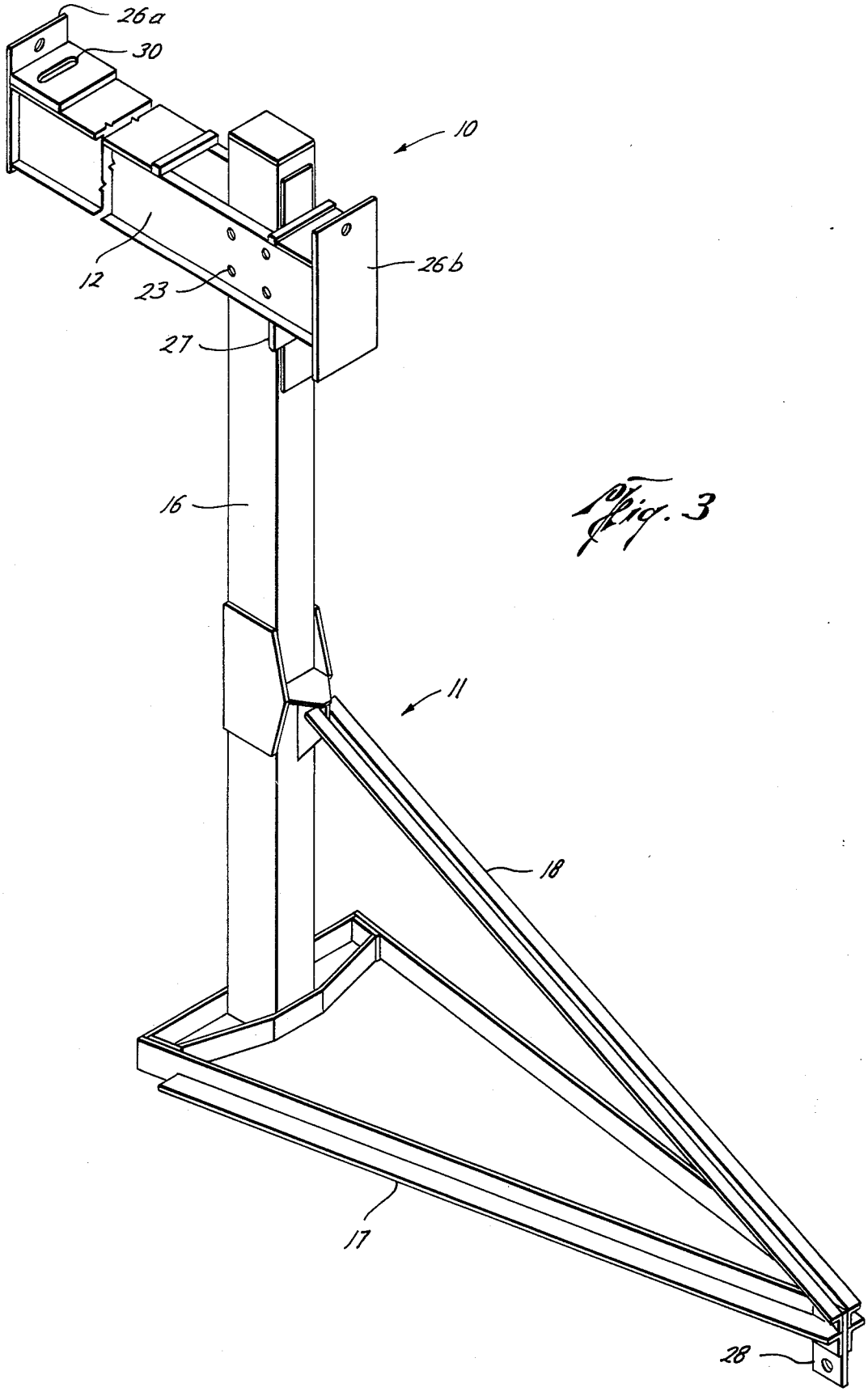
FIG. 3 is a schematic enlarged perspective view of the lift bracket assembly per se.

While various devices and assemblies may be utilized for carrying out or practicing the above disclosed methods, FIGS. 1–3 illustrate at least one inventive apparatus for practicing the above methods.

FIG. 1 discloses a lift bracket assembly 10 comprising a spider hanging bracket 11 and a crosshead support 12, all for supporting an inspector's/worker's cage 13 in a coke drum 14. FIG. 1 shows the assembly after it has been raised up through an opening in the bottom of the drum and set on a temporary deck 15 where it is assembled. In assembling the spider hanging bracket 11, a vertical support column 16 is fixed to a lift bracket yoke 17 at right angles thereto and braced with a lift bracket support 18. The crosshead support 12 is lowered down upon the top of the rim flange of the coke drum and secured thereto with a securing means, such as but not limited to, a bolt 19 in one end of the crosshead support protruding down through the support and top manway flange or drum rim flange 20 on the coke drum upper opening. As shown in FIG. 1, the spider hanging bracket 11 is raised with a hoist cable 21 up through the opening in the top of the coke drum with the vertical support column 16 passing up through the crosshead support 12 until a pattern of holes 22 in the top of the vertical support column 16 is aligned with a similar pattern holes 23 in the crosshead support.

Inspector's/worker's cage 13 is shown setting on the temporary deck with a hoist 24 secured to the cage having an end of the hoist cable 25 hooked to an outer end 28 of the lift bracket yoke 17 of the spider hanging bracket 11 above.

FIG. 2 shows the completely assembled lift bracket assembly 10 with the cage 13 being operated vertically for covering one sector or portion of the vertical internal wall surface of the large coke drum 14.

The crosshead support 12 is maintained on the top rim flanged surface by the weight of the assembly on the crosshead support, by the single bolt 19 connecting it to the coke drum, and stops. Attached to each end of the crosshead support 12 is a vertical plate **26*a*, 26*b*, which extends downwardly slightly below the lower surface of the crosshead support and contiguous with the outer peripheral edge surface of the drum rim flange 20. An internal guide projection 27 is secured to the under surface of the crosshead support and extends downwardly a small amount to engage the inner peripheral surface of the flange 20. Accordingly, the crosshead support 12** is prevented from sliding off the top of the coke drum by the above described detachable interconnecting retaining means.

FIG. 3, is an enlarged detailed perspective view of the lift bracket assembly 10 with the inspector's/worker's cage deleted for clarity of disclosure. The spider hanging bracket 11 is illustrated comprising horizontal lift bracket yoke 17 secured to the bottom of vertical support column 16 and held at right angles thereto with lift bracket support 18. The horizontally extending end of lift bracket yoke 17 has a suitable connecting bracket 28 for attaching thereto the upper end of hoist cable 25, FIG. 1, of the hoist 24 on the inspector's/worker's cage 13. A wear ring 29 is preferably mounted on the upper surface of the drum rim flange 20 on which the crosshead support 12 rests.

FIG. 3 illustrates the end plates **26*a*, 26*b* on crosshead support 12 for hooking over the outer vertical peripheral surface of the drum rim flange 20. Likewise, on the lower surface of the crosshead support 12 is secured the internal guide projection 27 for being positioned contiguous to the inner vertical peripheral surface of the drum rim flange 20. Bolt 19, FIG. 1, extends down through slot 30, FIG. 3, in crosshead 12, and then down through the manway flange 20, FIG. 1, under which it is bolted. Vertical support column 16 is hoisted until its pattern of holes (not shown) are aligned with the corresponding pattern of holes 23 in crosshead 12 for the inspection of bolts, or the like, for rigidly securing the spider hanging bracket 11 to the crosshead 12 for positioning the inspector's/worker's cage adjacent to the internal wall surface of the large drum. While only one bolt 19** is illustrated and described for clarity of disclosure, obviously more may be utilized for safety, if so desired.

In operation of the lift bracket assembly, the cage is then hoisted up for the full height of the coke drum and down again with the inspectors and/or workmen therein making a thorough inspection of, or working on, the inner surface of the coke drum. After the completion of one trip up and down, then the occupants of the cage vacate it, the bolt 19 is unfastened, and the crosshead support rotated through the predetermined angle to cover the next adjoining sector of the internal surface of the coke drum. Then the bolt 19 is replaced and the cage is re-entered by the occupants and the cage hoist is operated to be raised and lowered during another trip. This is repeated until the whole 360° rotation and inspection and/or work is finished on the internal wall surface of the coke drum.

Clearly, other inspection and/or working assemblies may be used than the disclosed assemblies in the disclosed method of inspecting and/or working in a large drum and an apparatus other than that disclosed may be manufactured for, or used in, the above disclosed method.

Obviously, other methods may be utilized for inspecting and/or working in a large drum and other methods may be utilized for assembling of forming an apparatus as disclosed hereinbefore.

Accordingly, it will be seen that the disclosed methods and mechanism will operate in a manner which meets each of the objects set forth hereinbefore.

While only one mechanism has been disclosed, it will be evident that various other modifications are possible in the arrangement and construction of the disclosed apparatus without departing from the scope of the invention, and it is accordingly desired to comprehend within the purview of this invention such modifications as may be considered to fall within the scope of the appended claims.

I claim:

1. A method for inspecting and/or working on the internal wall surface of a large drum having a flange on the top rim thereof comprising the steps of, a. assembling a right angled spider hanging bracket having a vertical support column and a horizontal lift bracket yoke, b. attaching a first hoist cable to the vertical support column, c. attaching an end of a cable from a second hoist on an inspector's/worker's cage to a protruding end of the horizontal lift bracket yoke, d. securing a crosshead support across the top of the drum rim flange, e. lifting the right angled spider hanging bracket with the first hoist to a position immediately under the drum rim flange with the vertical support column adjacent to the crosshead support and the horizontal lift bracket yoke protruding end extending to a position adjacent the wall surface, f. rigidly attaching the vertical support column to the crosshead support whereby the protruding end of the horizontal lift bracket yoke is adjacent to the drum wall surface, and g. hoisting the inspector's/worker's cage up and down from the protruding end of the horizontal lift bracket yoke adjacent the drum wall surface to cover one sector at a time of the drum internal wall surface for providing a fast, thorough, safe, economical, and efficient method of inspecting and/or working on the internal wall surface of a large drum.

2. A method as recited in claim 1 wherein after one sector of the drum internal surface is covered, the method is continued by, a. lowering the inspector's/worker's cage to the bottom of the drum, b. detaching the crosshead support from the drum rim flange, c. rotating the crosshead support on the upper surface of the drum rim flange through a predetermined angle of another sector, d. reattaching the crosshead support to the drum rim flange, and e. hoisting the inspector's/worker's cage up and down for inspecting and/or working on another sector of the drum internal wall surface.

3. A method as recited in claim 2 wherein the last method step comprises further, a. rotating the crosshead support on the drum rim flange through the predetermined angle after each successive inspection/work trip until a rotation of 360° is traversed or the tank inspection and/or work is completed.

4. A method as recited in claim 1 wherein the penultimate step comprises further, a. securing detachable interconnecting means between the crosshead support and the drum rim flange to maintain the crosshead support on the drum rim flange when the inspector's/worker's cage is being hoisted up and down, and b. detaching the crosshead support from the drum rim flange when the inspector's/worker's cage is rotated to another sector of the drum internal wall surface.

5. A lift bracket assembly for use in inspecting and/or working on the internal wall surface of a large drum having a flange on the periphery of an opening in the top thereof comprising, a. crosshead support means having locking means for detachably connecting said crosshead support means to a large drum top peripheral flange, b. said locking means comprising detachable means penetrating both said crosshead support means and said large drum top peripheral flange, c. spider hanging bracket means rigidly connected to said crosshead support means, d. said spider hanging bracket means having an end extending to a position adjacent to said drum internal wall surface, e. inspector's/worker's cage means having hoist means thereon with a hoist line connected to said spider hanging bracket means extended end, and f. said inspector's/worker's cage means being responsive to said hoist means for traversing a sector of said drum internal wall surface from top to bottom for providing a fast, thorough, safe, economical, and efficient system for inspecting and/or working on the internal wall surface of said large drum.

6. A lift bracket assembly as recited in claim 5 wherein said spider hanging bracket means comprises, a. a horizontal lift bracket yoke rigidly connected at right angles to a vertical support column, b. a lift bracket support interconnecting said horizontal lift bracket yoke with said vertical support column, and c. said vertical support column has an upper end with a connecting means thereon.

7. A lift bracket assembly as recited in claim 5 wherein, a. said crosshead support means has a connecting means adjacent to one end thereof corresponding to said connecting means on said vertical support column for rigidly interconnecting said spider hanging bracket means to said crosshead support means for positioning said spider hanging bracket means end adjacent to said drum internal wall surface.

8. A lift bracket assembly as recited in claim 7 wherein, a. said crosshead support means has a first pattern of horizontal holes in one end thereof, b. said vertical support column has a second pattern of horizontal holes in an upper end thereof corresponding to said first pattern of holes, and c. bolt means for interconnecting said two patterns of horizontal holes for detachably and rigidly interconnecting said spider hanging bracket means to said crosshead support means for supporting said inspector's/worker's cage means adjacent to said drum internal wall surface.

9. A lift bracket assembly for use in inspecting and/or working on the internal wall surface of a large drum having a flange on the periphery of an opening in the top thereof comprising, a. crosshead support means having locking means for detachably connecting said crosshead support means to a large drum top peripheral flange, b. spider hanging bracket means rigidly connected to said crosshead support means, c. said spider hanging bracket means having an end extending to a position adjacent to said drum internal wall surface, d. inspector's/worker's cage means having hoist means thereon with a hoist line connected to said spider hanging bracket means extended end, e. said inspector's/worker's cage means being responsive to said hoist means for traversing a sector of said drum internal wall surface from top to bottom for providing a fast, through, safe, economical, and efficient system for inspecting and/or working on the internal wall surface of said large drum, and f. said locking means comprising, 1. projection means extending downwardly from each end of said crosshead support means contiguous to the outer peripheral surface of said drum top flange, 2. projection means extending downwardly from the lower surface of one end of said crosshead support means contiguous to the inner peripheral surface of said drum top flange, 3. detachable fastening means for attaching the other end of said crosshead support means to said drum top flange whereby said spider hanging bracket means may be detached from said drum top flange, rotated through a sector, and reattached to said drum top flange, and 4. said crosshead support means being responsive to said locking means and said hoist means for traversing said inspector's/worker's cage through sectors completely around said drum internal wall surface.

* * * * *